US006170471B1

(12) United States Patent
Yonezawa et al.

(10) Patent No.: US 6,170,471 B1
(45) Date of Patent: Jan. 9, 2001

(54) ENGINE PUMP DRIVE

(75) Inventors: Minoru Yonezawa; Yuji Kinoshita, both of Iwata (JP)

(73) Assignee: Yamaha Hatsudoki Kabushiki Kaisha, Iwata (JP)

( * ) Notice: Under 35 U.S.C. 154(b), the term of this patent shall be extended for 0 days.

(21) Appl. No.: 09/390,949

(22) Filed: Sep. 7, 1999

(30) Foreign Application Priority Data

Sep. 7, 1998 (JP) ..... H10-252373

(51) Int. Cl.[7] ..... F02M 37/04
(52) U.S. Cl. ..... 123/508; 123/509
(58) Field of Search ..... 123/509, 90.27, 123/193.5, 193.3

(56) References Cited

U.S. PATENT DOCUMENTS 5,161,496 * 11/1992 Matsushima et al. ..... 123/508
5,390,642 * 2/1995 Thoma ..... 123/508
5,477,835 * 12/1995 Nuti ..... 123/509
5,603,303 * 2/1997 Okajima et al. ..... 123/509
5,806,499 * 9/1998 Stover et al. ..... 123/509
5,829,414 * 11/1998 Tsunoda et al. ..... 123/509
5,899,181 * 5/1999 Kurata et al. ..... 123/508
6,070,564 * 6/2000 Hiraoka et al. ..... 123/509
6,082,336 * 7/2000 Takahashi et al. ..... 123/509

* cited by examiner

*Primary Examiner*—Thomas N. Moulis
(74) *Attorney, Agent, or Firm*—Knobbe, Martens, Olson & Bear LLP

(57) ABSTRACT

A cylinder head and high pressure mechanical fuel pump drive for an overhead cam shaft internal combustion engine. The cylinder head in the area of one of its cam shafts is formed with an extending ledge to which a fuel pump mounting member is affixed. This ledge and the mounting member are formed with a bore that receives a cylindrical portion of the housing of the fuel pump and which portion journals the pump driveshaft. A simple O-ring seal seals the pump mechanism in this area from the cam shaft chamber and facilitates a driving connection between the end of the cam shaft and the pump driveshaft.

8 Claims, 5 Drawing Sheets

ENGINE PUMP DRIVE

BACKGROUND OF THE INVENTION

This invention relates to an internal combustion engine and more particularly to a high pressure fuel injection pump drive for such engines.

In order to improve the performance and particularly the fuel economy and exhaust emission control of internal combustion engines it has been proposed to employ direct cylinder injection. Use of such direct cylinder injection has a number of advantages and offers opportunities for significantly improving engine performance. However, the provision of direct cylinder injection requires use of a high pressure pump in order to generate adequate fuel pressure to permit penetration into the combustion chamber, particularly during the compression stroke.

Therefore, it has been generally necessary to employ a high pressure pump which generally is a mechanical pump of the positive displacement type and which must be driven from the engine. This adds considerably to the complexity of the engine construction, bearing in mind the number of other accessories and auxiliaries that are driven by the engine, particularly in automotive practice.

In connection with overhead cam shaft engines, it has been proposed to drive the high pressure fuel injection pump off of one end of one of the cam shafts of the engine. Generally, these ends provide an area that is otherwise unencumbered and also permit the mounting of the high pressure pump in proximity to the fuel injectors.

However, it is necessary to mount the pump in such a way that a driving relationship is accomplished and also so that there is no leakage of oil from the cam shaft chamber to the exterior of the engine in the area where the pump is driven.

The arrangements that have been proposed for this type of drive have disadvantages. First, many of these types of arrangement require end seals on the sealing surface between the pump housing and the cylinder head and cam cover of the engine. Because of these several parting edges, there is a difficulty of ensuring good gasket sealing in this way.

Also, many of the pump drives that have been proposed utilize the cam shaft bearing cap for the engine as a means also to attach the fuel pump housing to the engine. This gives rise to rather bulky constructions which can offset the advantages of compact construction and ease of assembly and servicing.

It is, therefore, a principal object of this invention to provide an improved mounting and sealing arrangement for a high pressure fuel pump drive from the cam shaft of an overhead cam shaft internal combustion engine.

It is a further object of this invention to provide an improved pump mounting structure for the high pressure pump of an internal combustion engine driven off of one of the cam shafts that will provide good sealing as well as a simple and compact construction.

SUMMARY OF THE INVENTION

This invention is adapted to be embodied in a fuel pump drive arrangement for an overhead cam shaft internal combustion engine. The engine is comprised of a cylinder head that has at least one overhead cam shaft journaled therein. This cam shaft is contained within a cam shaft cover that has a sealing surface that is engaged with a sealing surface of the cylinder head. A portion of the cylinder head where these sealing surfaces is formed is provided with an extension. A housing support member is affixed to this extension and defines with the cylinder head a bore that is adapted to receive a cylindrical portion of the fuel pump housing and which bore is in alignment with the axis of rotation of the cam shaft. The fuel pump has a driveshaft that extends through this housing part and which is drivingly coupled to the cam shaft.

DETAILED DESCRIPTION OF THE PREFERRED EMBODIMENT OF THE INVENTION

Figure 1:
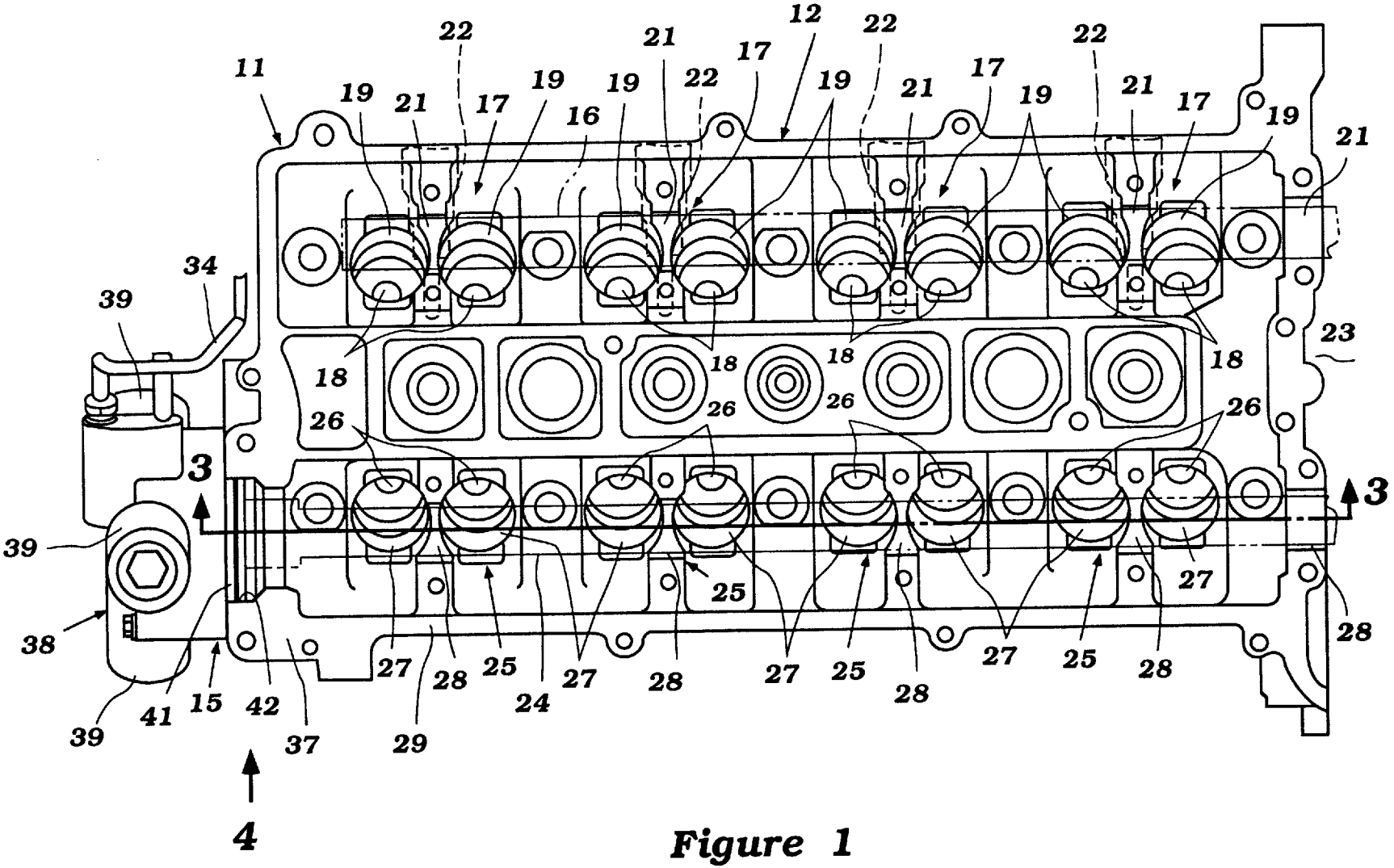
FIG. 1 is a top plan view of a cylinder head of an internal combustion engine constructed in accordance with an embodiment of the invention with the cam shafts and valve actuating mechanism as well as the cam cover removed so as to show the mounting arrangement for the high pressure fuel pump.

Referring now in detail to the drawings, a cylinder head assembly constructed in accordance with an embodiment of the invention is illustrated and is identified generally by the reference numeral 11. The cylinder head assembly 11 includes basically a main cylinder head member, indicated by the reference numeral 12, a cam cover that is affixed to the cylinder head member 12 in a manner to be described and which cam cover is indicated generally by the reference numeral 13, a high pressure fuel pump mounting member, indicated generally by the reference numeral 14, and a high pressure fuel pump 15 of the positive displacement type.

Since the invention deals primarily with the manner in which the fuel pump 15 is mounted on the cylinder head assembly 11 and driven by one of the engine cam shafts, it is not believed necessary for those skilled in the art to understand the invention to have a complete description of the entire engine construction. Primarily only those components that are involved directly or primarily with the mounting for the fuel pump 15 and its drive have been illustrated and will be described in detail. It should be readily apparent to those skilled in the art from the following description how the invention can be utilized to mount a high pressure fuel pump or other engine driven accessory with any of a wide variety of types of engine constructions.

Referring now primarily to the cylinder head assembly 11 and the basic cylinder head construction, the associated engine is of the twin overhead cam shaft type and includes an intake cam shaft, which is shown in phantom in FIG. 1 and identified by the reference numeral 16. This intake cam shaft assembly 16 operates with an intake valve actuating mechanism 17 provided on this side of the cylinder head assembly 12 and which actuate poppet type intake valves which do not appear in the figure but which have their stem portion slideably supported within guide openings 18 formed by valve guides, either machined directly into the cylinder head member 12 or separately affixed thereto.

Each intake valve actuating mechanism 17 further includes a plurality of cylindrical bore 19 that are formed in the cylinder head member 12 and each of which is adapted to receive a thimble tappet (not shown) for actuating the associated intake valve. Finally, the area between the pairs of tappet receiving bores 19 associated with each cylinder is formed with a machined bearing surface 21 with which a bearing cap 22 cooperates so as to journal the intake cam shaft 16 for rotation in the cylinder head in a manner which is well known in this art.

Viewing FIG. 1, the cam shaft 16 extends to the right hand side into a timing case 23 in which a suitable timing mechanism is provided for driving the intake cam shaft 16 from the engine crankshaft at one-half crankshaft speed.

The side of the cylinder head 12 opposite to that where the intake cam shaft 16 is journaled comprises the exhaust side in this particular embodiment and an exhaust cam shaft, also shown in phantom and identified by the reference numeral 24, is mounted therein in a manner to be described for operating the exhaust valves through an exhaust valve actuating mechanism shown partially and identified by the reference numeral 25. This exhaust valve actuating mechanism is incorporated for operating poppet type exhaust valves which, like the intake valves are not shown. However, these exhaust valves have their stem portions slideably supported in valve guide openings 26 formed in the cylinder head assembly 11 in a manner similar to that of intake valve guide openings 18.

The exhaust valve guide openings 26 are concentrically arranged with tappet receiving bores 27 that, like on the intake side, receive thimble tappets for operating the exhaust valves.

Between the pair of tappet receiving bores 26 for each cylinder, the cylinder head member 12 is provided with machine bearing surfaces 28. Bearing caps, which are not shown in phantom in this figure are mounted on the cylinder head and cooperate with these bearing surfaces 28 for rotatably journaling the exhaust cam shaft 24 in a manner as well known in this art.

The end of the exhaust cam shaft 24 in the timing case 23 is also driven by the aforenoted timing drive.

The cylinder head member 12 is provided with a machined surface 29 that extends along the outer periphery of the cylinder head assembly 11. It is with this surface that the cam cover 13 is sealingly engaged with a suitable interposed gasket so as to seal the valve actuating mechanism thus far described and prevent oil leakage therefrom.

Figure 5:
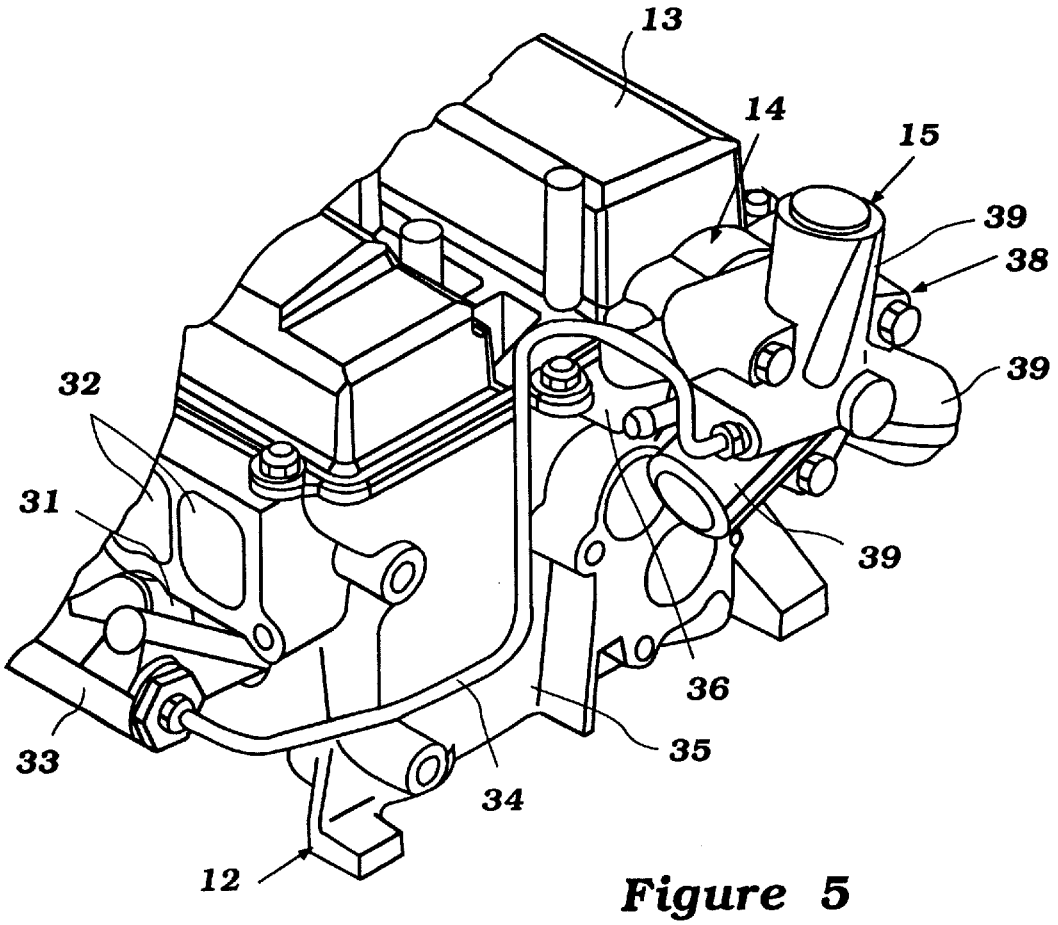
FIG. 5 is a perspective view looking from one end of the engine and showing the same component as illustrated in FIG. 4.
Figure 6:
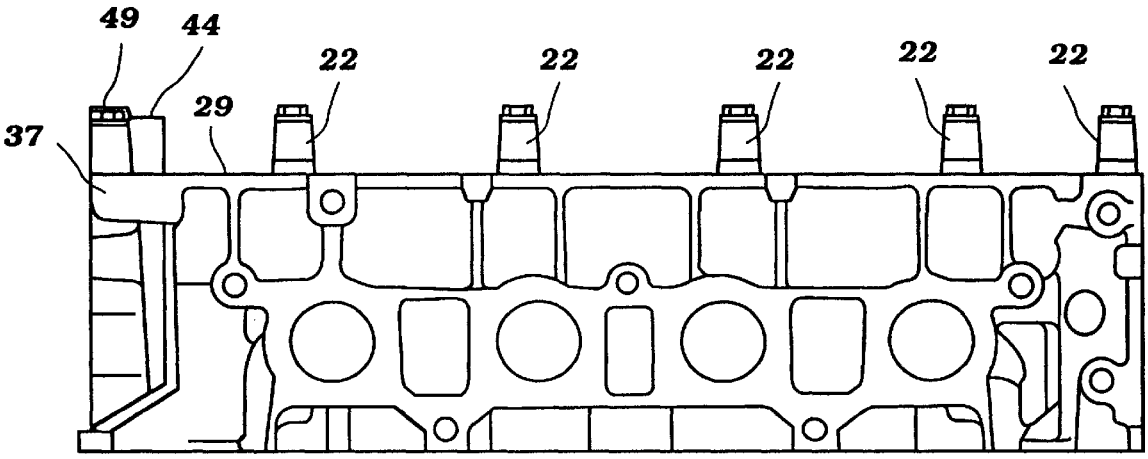
FIG. 6 is an enlarged side elevational view of the cylinder head with the cam shaft bearing caps and fuel pump housing support being attached.
Figure 7:
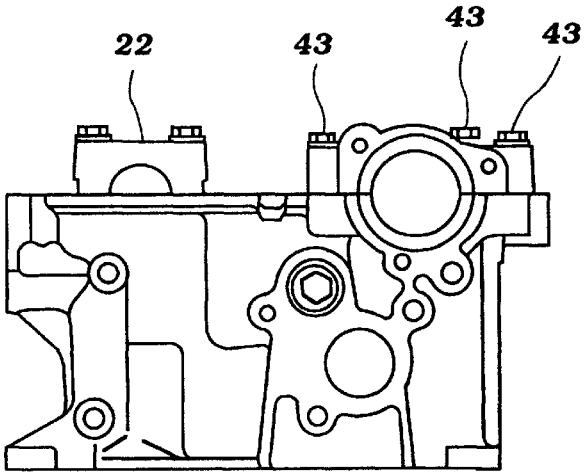
FIG. 7 is a front elevational view of the elements of the cylinder head as seen in FIG. 6.

As has been noted, the engine is provided with a direct injection system and this includes a plurality of fuel injectors, one of which is appears in FIG. 5 and is identified therein by the reference numeral 31. These fuel injectors 31 are positioned below a pair of intake ports 32 which supply the air charge to the combustion chambers of the engine. A fuel rail 33 is associated with these fuel injectors 31 for delivering the fuel thereto. The fuel rail 33 receives fuel that is supplied under high pressure from the fuel injection pump 15 through a conduit 34.

At this end of the engine, the cylinder head member 12 basically terminates in an end surface 35. However, on the exhaust side of this end surface 35, the cylinder head 12 is provided with an extending mounting portion 36 which forms in part a mounting surface for the high pressure fuel pump 15. This mounting portion 36 has an upper surface 37 which forms in essence an extension of the cylinder head machined surface 29 so as to facilitate machining and simplify the overall construction.

The high pressure fuel pump 15 has an outer housing assembly that is comprised of a main housing member, indicated generally by the reference numeral 38. This housing member has projections 39, each of which forms a respective pumping chamber 39 in which a pistons reciprocates so as to generate the required high pressure for the fuel injection system.

This pump housing member 38 has a cylindrical extending portion 41 that is received within a corresponding shaped recess or bore that is formed by a first semi-cylindrical surface 42 that is formed in the cylinder head extending mounting portion 36. A mounting cap 14 is affixed to this surface 37 by means of threaded fasteners 43 and has a smaller diameter portion 44 that bridges the area between the fasteners 43 and the front face of the cam cover 13 and which may have a suitable face seal therewith.

This mounting member 14 is also formed with a semi-cylindrical bore that is the same diameter as the cylinder head bore 43 so as to provide a firm mounting arrangement for the fuel pump on this extension of the cylinder head assembly.

Figure 2:
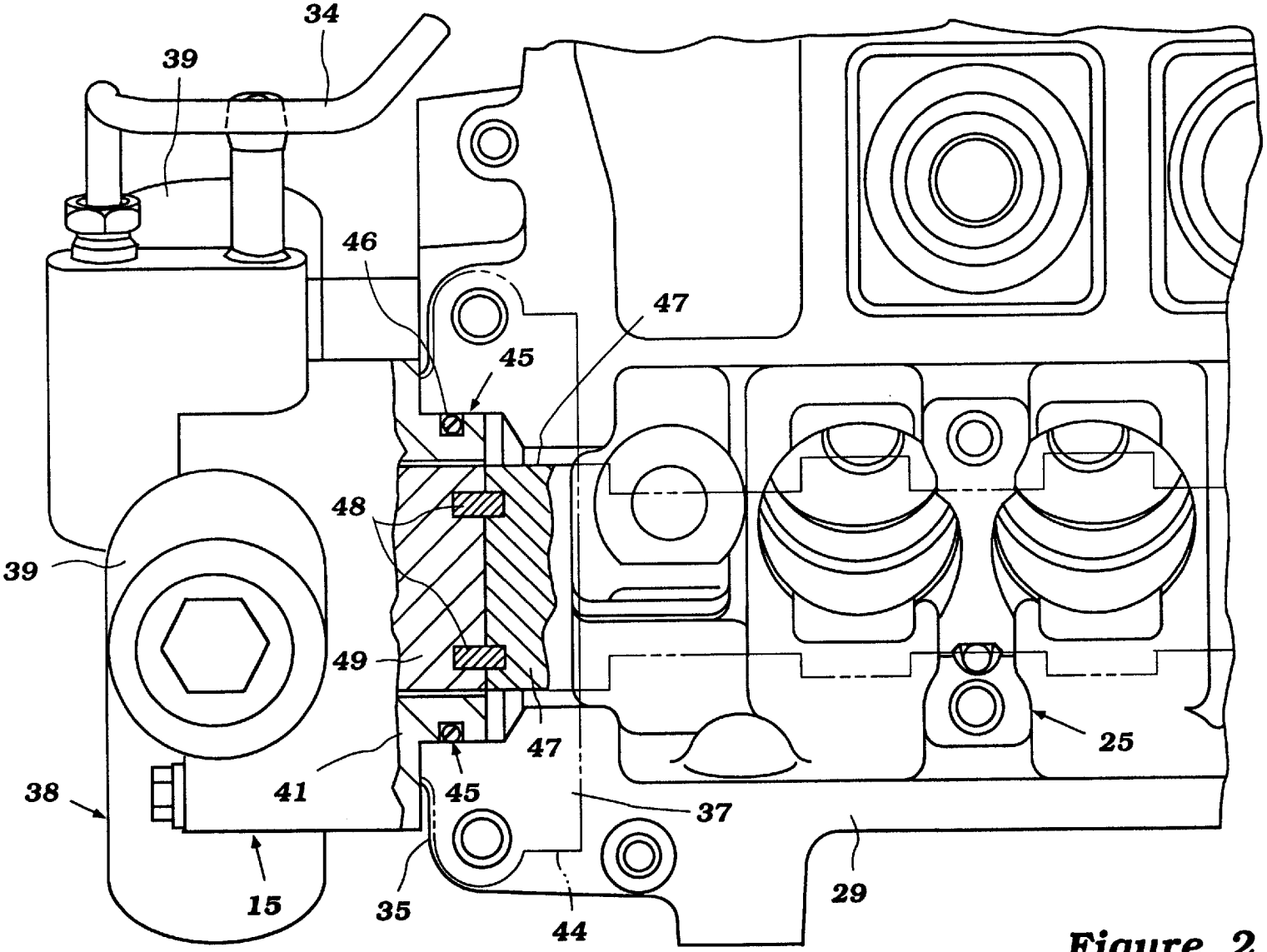
FIG. 2 is a view looking in the same direction as FIG. 1 and shows specifically the area of the fuel pump drive and shows the fuel pump mounting member in phantom.
Figure 3:
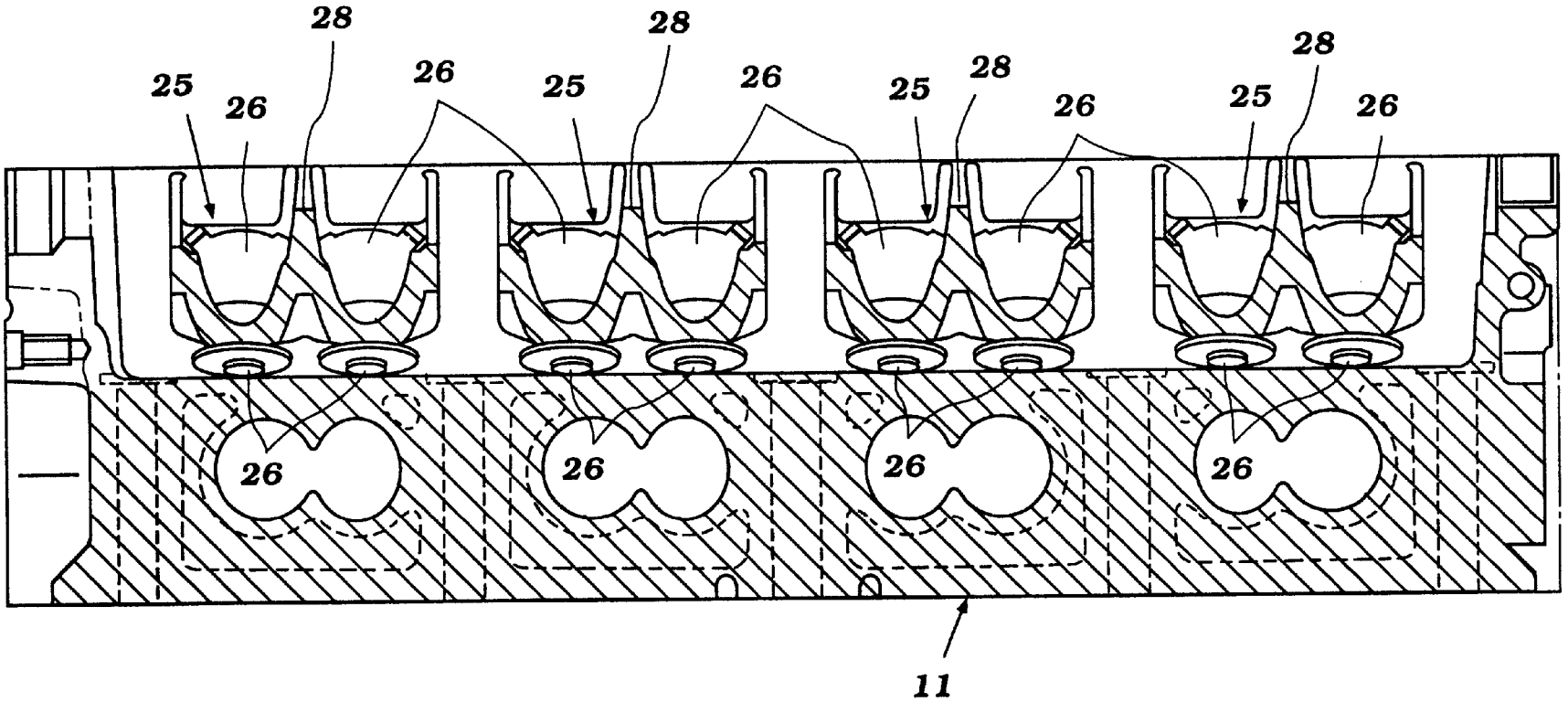
FIG. 3 is a cross-sectional view taken along the line 3—3 of FIG. 1.
Figure 4:
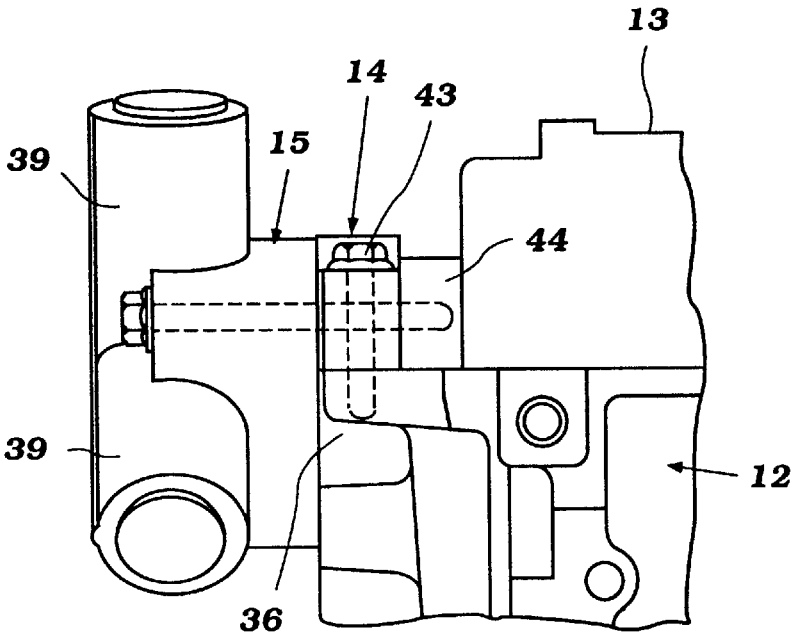
FIG. 4 is a side elevational view of the portion of the cylinder head assembly shown in FIGS. 1 and 2 and is taken looking generally in the direction of the arrow 4 in FIG. 1.

As may be best seen in FIG. 2, the fuel pump housing portion 41 has a cylindrical groove 45 that receives an O-ring type seal so as to provide a very simple and yet highly effective oil seal in this area. This oil seal includes an O-ring 46 that is received in the groove 45 in the pump housing portion 41.

The exhaust cam shaft 24 has a drive portion 47 formed thereon which receives a pair of drive keys 48 that are also coupled to the driveshaft 49 of the high pressure fuel pump 15. Thus, the fuel pump is very effectively driven and the cylinder head configuration is not significantly enlarged so as to accommodate this drive while still maintaining a very compact overall construction.

Of course, it should be readily apparent to those skilled in the art that the foregoing description is that of a preferred embodiment of the invention. Various chambers and modifications may be made without departing from the spirit and scope of the invention, as defined by the appended claims.

What is claimed is:

1. An overhead cam shaft internal combustion engine fuel pump drive arrangement, said engine being comprised of a cylinder head that has at least one overhead cam shaft journaled therein, said cam shaft being contained within a cam shaft cover that has a sealing surface that is engaged with a sealing surface of said cylinder head, a portion of said cylinder head contiguous to said sealing surfaces being provided with an extension, a pump housing support member affixed to said cylinder head extension and defines therewith a bore receiving a cylindrical portion of a fuel pump housing, said bore being in alignment with the axis of rotation of said cam shaft, said fuel pump having a drive shaft that extends through pump housing support member and which is drivingly coupled to said cam shaft.

2. An overhead cam shaft internal combustion engine as set forth in claim 1 wherein the cylinder head journals a pair of cam shafts, one at each side thereof.

3. An overhead cam shaft internal combustion engine as set forth in claim 2 wherein a fuel pump is driven by only one of the cam shafts.

4. An overhead cam shaft internal combustion engine as set forth in claim 3 wherein the cylinder head is only extended on the side thereof where the fuel pump is driven.

5. An overhead cam shaft internal combustion engine as set forth in claim 1 wherein the bore and the cylindrical part of the fuel pump housing define a groove in which an O-ring seal is trapped.

6. An overhead cam shaft internal combustion engine as set forth in claim 5 wherein the cylinder head journals a pair of cam shafts, one at each side thereof.

7. An overhead cam shaft internal combustion engine as set forth in claim 6 wherein a fuel pump is driven by only one of the cam shafts.

8. An overhead cam shaft internal combustion engine as set forth in claim 7 wherein the cylinder head is only extended on the side thereof where the fuel pump is driven.

* * * * *